US008720094B2

(12) United States Patent
McPherson

(10) Patent No.: US 8,720,094 B2
(45) Date of Patent: May 13, 2014

(54) CURVED HANDGUN

(71) Applicant: Taurus International Manufacturing, Inc., Miami, FL (US)

(72) Inventor: Mathew A. McPherson, Norwalk, WI (US)

(73) Assignee: Taurus International Manufacturing, Inc., Miami, FL (US)

( * ) Notice: Subject to any disclaimer, the term of this patent is extended or adjusted under 35 U.S.C. 154(b) by 0 days.

(21) Appl. No.: 13/621,909

(22) Filed: Sep. 18, 2012

(65) Prior Publication Data

US 2013/0312304 A1 Nov. 28, 2013

Related U.S. Application Data

(60) Provisional application No. 61/651,505, filed on May 24, 2012.

(51) Int. Cl.
*F41C 23/10* (2006.01)

(52) U.S. Cl.
USPC ..... 42/6; 42/71.01; 42/71.02; 42/7

(58) Field of Classification Search
USPC ..... 42/6, 7, 17, 18, 21, 22, 29, 33, 35, 37, 42/39, 49.02, 50, 52, 71.01, 71.02; D22/103, 104; 124/51.1, 52
See application file for complete search history.

(56) References Cited

U.S. PATENT DOCUMENTS

| | | | | | |
|---|---|---|---|---|---|
| 105,093 | A | * | 7/1870 | Kraffert | 42/17 |
| D7,933 | S | | 12/1874 | Richards | |
| 297,412 | A | | 4/1884 | Kelton | |
| 357,461 | A | * | 2/1887 | Burgess | 42/22 |
| 384,161 | A | * | 6/1888 | Hindley | 42/50 |
| 477,666 | A | * | 6/1892 | Loomis | 42/37 |
| 562,455 | A | * | 6/1896 | Bye | 42/7 |
| 566,367 | A | * | 8/1896 | Wright | 42/7 |
| 597,935 | A | * | 1/1898 | Ashton | 42/18 |
| 696,539 | A | * | 4/1902 | Bennet | 42/60 |
| 839,938 | A | * | 1/1907 | Lister | 42/7 |
| 980,980 | A | * | 1/1911 | Maggio | 89/147 |
| 992,854 | A | * | 5/1911 | Cobb | 89/147 |
| 1,042,837 | A | | 10/1912 | Tatarek | |
| 1,308,665 | A | * | 7/1919 | Douglas | 42/49.01 |
| 1,451,339 | A | * | 4/1923 | Kottas | 42/17 |
| 1,898,368 | A | | 2/1933 | Hess et al. | |
| 1,962,775 | A | | 6/1934 | Jones | |
| 2,908,987 | A | * | 10/1959 | Allyn | 42/18 |
| 3,128,571 | A | | 4/1964 | Herrett | |
| 3,276,323 | A | | 10/1966 | Dieckmann | |
| RE26,872 | E | * | 4/1970 | Dieckmann | 89/195 |
| D230,974 | S | | 3/1974 | Howlett | |

(Continued)

FOREIGN PATENT DOCUMENTS

| | | |
|---|---|---|
| EP | 0272819 | 8/1993 |
| EP | 1586846 | 10/2005 |
| WO | 00-65293 | 11/2000 |

*Primary Examiner* — Bret Hayes
*Assistant Examiner* — Derrick Morgan
(74) *Attorney, Agent, or Firm* — Robert Curcio; DeLio, Peterson & Curcio, LLC

(57) ABSTRACT

Example handguns, such as pistols and revolvers, have specifically curved or contoured shapes that make them particularly suited for fitting comfortably within front, rear or side pants pockets. In some examples, the handguns can be completely concealed within standard pants pockets.

19 Claims, 8 Drawing Sheets

(56) References Cited

U.S. PATENT DOCUMENTS

| | | | | | |
|---|---|---|---|---|---|
| 4,058,922 | A | * | 11/1977 | Elbe et al. | 42/16 |
| D247,855 | S | | 5/1978 | Schiermeier | |
| D257,166 | S | | 9/1980 | Hogue | |
| 4,332,097 | A | * | 6/1982 | Taylor, Jr. | 42/50 |
| 4,566,212 | A | * | 1/1986 | Chesnut | 42/50 |
| 4,689,907 | A | * | 9/1987 | Gwinn, Jr. | 42/50 |
| 4,862,618 | A | | 9/1989 | Szabo | |
| 4,862,620 | A | * | 9/1989 | Chesnut et al. | 42/50 |
| 4,878,304 | A | | 11/1989 | Cupp | |
| 4,901,463 | A | * | 2/1990 | Chesnut | 42/50 |
| 4,982,520 | A | * | 1/1991 | Lee | 42/49.01 |
| 5,052,138 | A | * | 10/1991 | Crain | 42/1.02 |
| 5,406,731 | A | | 4/1995 | Stevens | |
| 5,425,299 | A | | 6/1995 | Teetzel | |
| 5,502,913 | A | * | 4/1996 | Jackson | 42/50 |
| 5,956,878 | A | | 9/1999 | Yang | |
| 6,736,125 | B2 | * | 5/2004 | Petrosyan et al. | 124/51.1 |
| 6,804,907 | B1 | | 10/2004 | Slobodkin | |
| 7,634,959 | B2 | * | 12/2009 | Frickey | 89/136 |
| 7,765,997 | B2 | * | 8/2010 | Klockener et al. | 124/48 |
| 7,823,312 | B2 | * | 11/2010 | Faifer | 42/49.02 |
| 8,006,423 | B1 | | 8/2011 | Alzamora et al. | |
| 8,186,086 | B2 | | 5/2012 | Gu-Ari et al. | |
| 8,484,875 | B2 | * | 7/2013 | Heath | 42/49.01 |
| D687,505 | S | * | 8/2013 | Knorst et al. | D22/103 |
| 2004/0107621 | A1 | * | 6/2004 | Segalle | 42/71.02 |
| 2013/0180144 | A1 | * | 7/2013 | Kresser et al. | 42/1.05 |

* cited by examiner

CURVED HANDGUN

CROSS REFERENCE TO RELATED APPLICATIONS

This application claims the benefit of provisional patent application Ser. No. 61/651,505 filed on May 24, 2012 by the present inventor.

FIELD OF THE DISCLOSURE

The subject invention generally pertains to handguns and more specifically to means for comfortably carrying and concealing a handgun.

BACKGROUND

Pistols and revolvers are examples of handguns. A cartridge is a combination of a bullet and a shell, wherein the shell contains the gunpowder that upon exploding within the firing chamber of a handgun blows the bullet as a projectile out through the barrel of the handgun.

In the example of pistols, the firing chamber is generally integral with the barrel and usually a linear magazine within the handle grip of the pistol sequentially feeds a series of cartridges to the firing chamber. In the example of revolvers, a rotatable cylinder with a series of circumferentially distributed firing chambers align sequentially a series of cartridges with the revolver's barrel.

DETAILED DESCRIPTION

Figure 9:
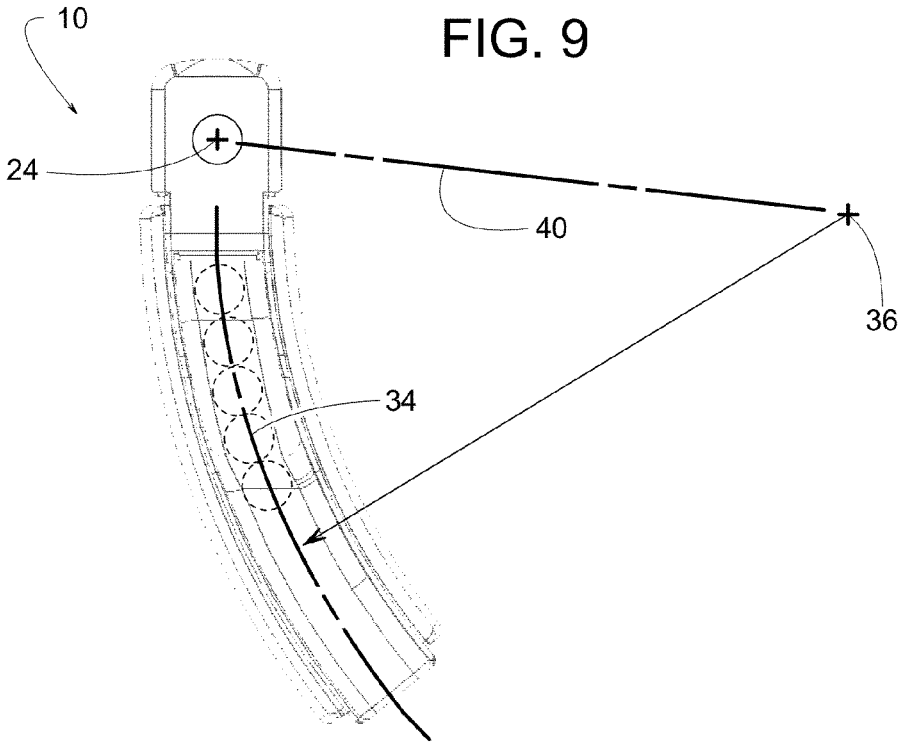
FIG. 9 is a front view similar to FIG. 7 but also showing additional geometric lines.
Figure 10:
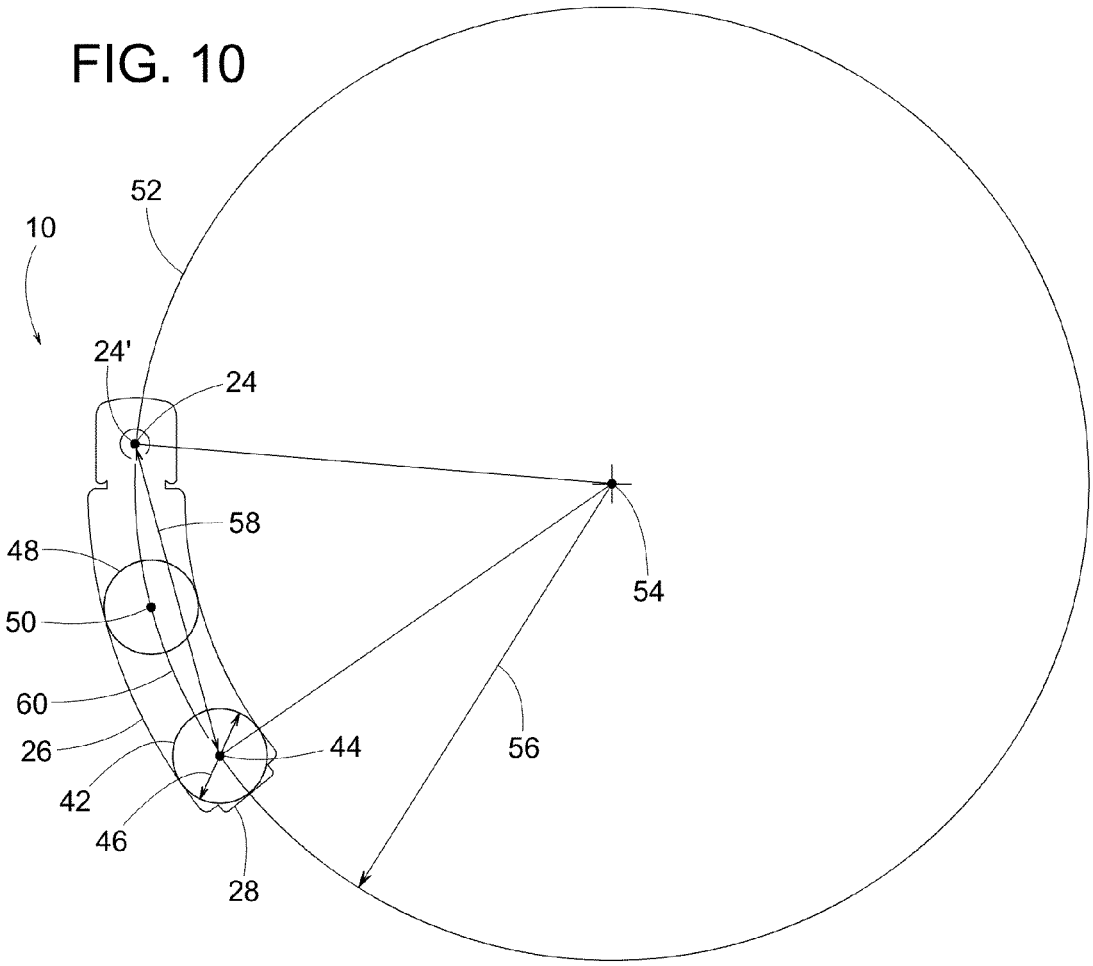
FIG. 10 is a silhouette end view of FIG. 7 with various geometric references.
Figure 16:
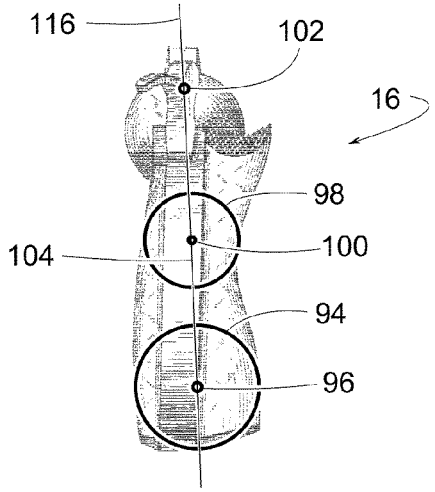
FIG. 16 Prior Art
FIG. 16 is an end view of a prior art handgun with various geometric references.
Figure 17:
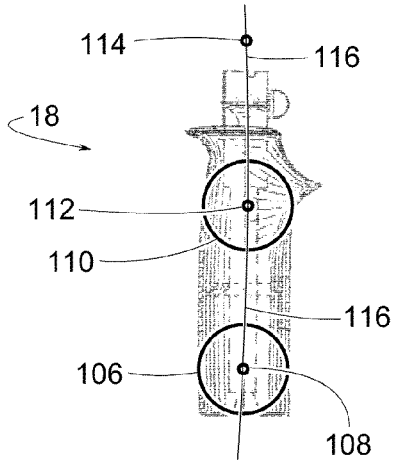
FIG. 17 Prior Art
FIG. 17 is an end view of a prior art handgun with various geometric references.
Figure 11:
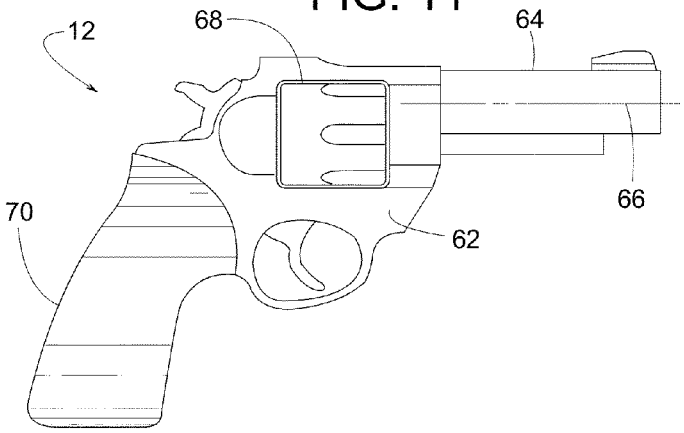
FIG. 11 is a right side view of another example handgun.
Figure 12:
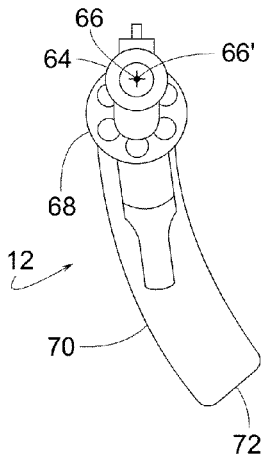
FIG. 12 is a front end view of FIG. 11.
Figure 13:
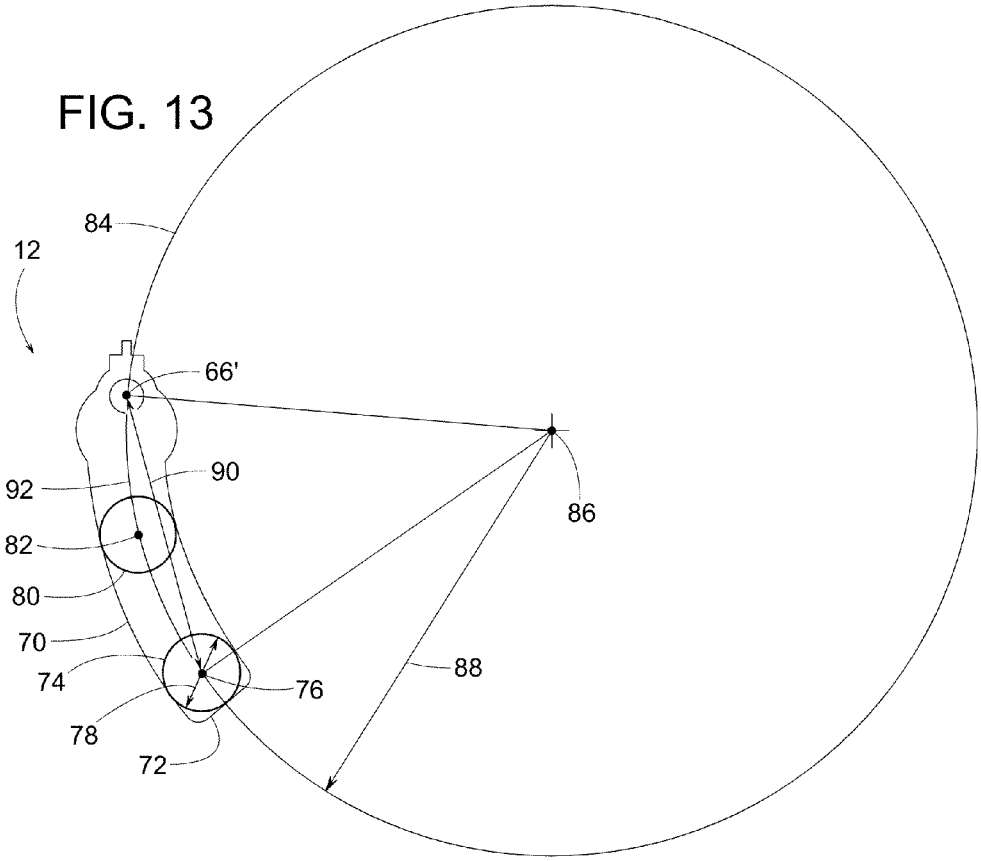
FIG. 13 is a silhouette end view of FIG. 12 with various geometric references.
Figure 14:
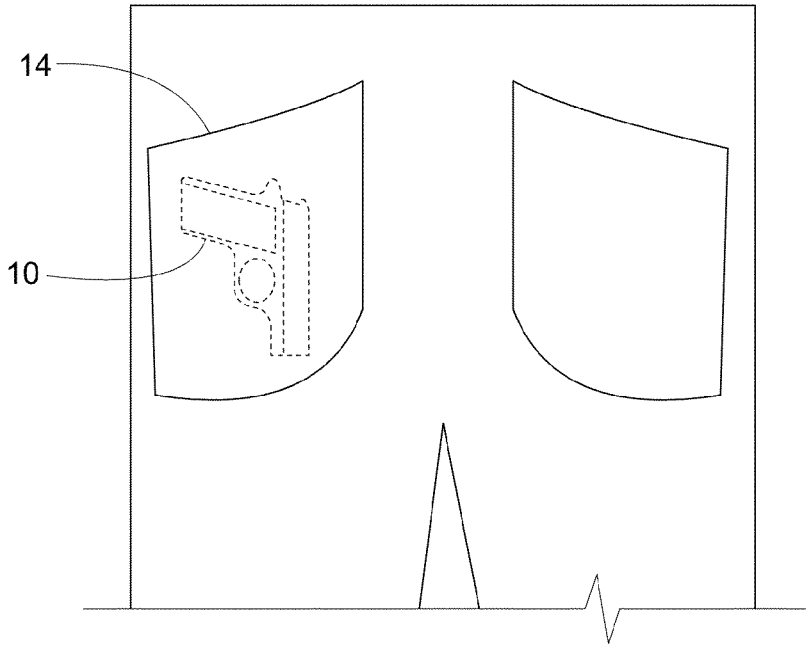
FIG. 14 shows an example pistol completely concealed within the pocket of a pair of pants.
Figure 15:
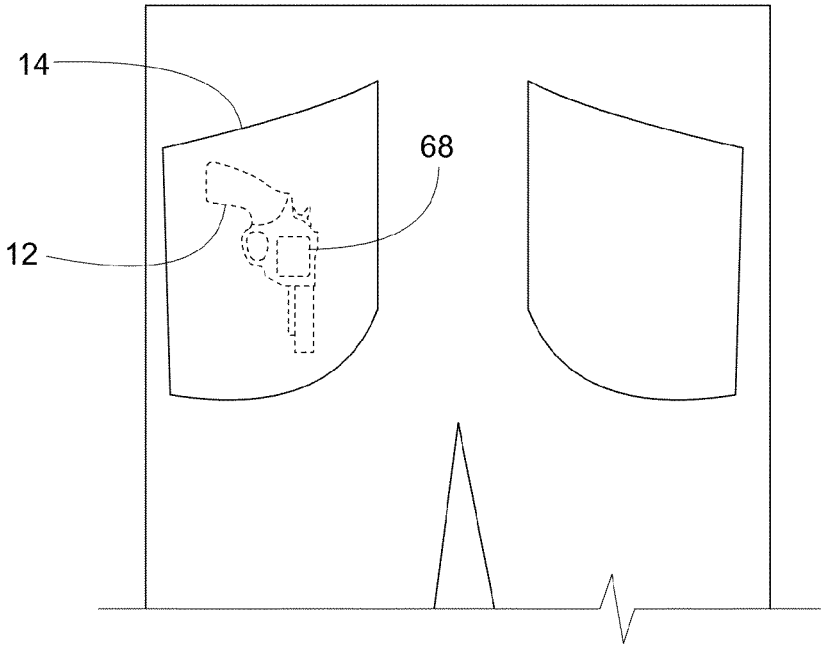
FIG. 15 shows an example revolver completely concealed within the pocket of a pair of pants.

FIGS. 1-10 illustrate an example handgun 10 in the form of a pistol, and FIGS. 11-13 show an example handgun 12 in the form of a revolver. Both handguns 10 and 12 are specifically shaped to fit comfortably within a pocket 14 of a pair of pants. FIG. 14 shows handgun 10 completely concealed within pocket 14, and FIG. 15 shows handgun 12 completely concealed within pocket 14. FIGS. 16 and 17 show prior art handguns 16 and 18, wherein handgun 16 is based on U.S. Pat. No. 297,412; and handgun 18 is based on U.S. Pat. No. 1,898,368.

Referring to FIGS. 1-10, handgun 10 comprises a frame 20, a barrel 22 defining a longitudinal centerline 24 (projectile centerline), and a handle 26 extending from longitudinal centerline 24 and terminating at a distal end 28. Handle 26 extending from longitudinal centerline 24 does not necessarily mean that handle 26 intersects or touches longitudinal centerline 24, but rather it means that handle 26 protrudes in a direction leading away from longitudinal centerline 24. Distal end 28 is sometimes referred to as the butt of a handgun. In some examples, handle 26 comprises one or more various additional items including, but not limited to, one or more grips 30, a magazine 32 (FIG. 8), and a magazine well. In examples where handgun 10 includes magazine 32, handle 26 has a magazine chamber within which magazine 32 is removably inserted. A magazine well provides the butt with a tapered lead-in that helps guide magazine 32 into the magazine chamber.

In some examples, handle 26 is fastened to frame 20, wherein handle 26 and frame 20 are two discrete pieces. In other examples handle 26 is an integral extension of frame 20, wherein handle 26 and frame 20 are a single piece. In some examples, handle 26 is fastened to barrel 22, wherein handle 26 and barrel 22 are two discrete pieces. In other examples handle 26 is an integral extension of barrel 22, wherein handle 26 and barrel 22 are a single piece.

Figure 1:
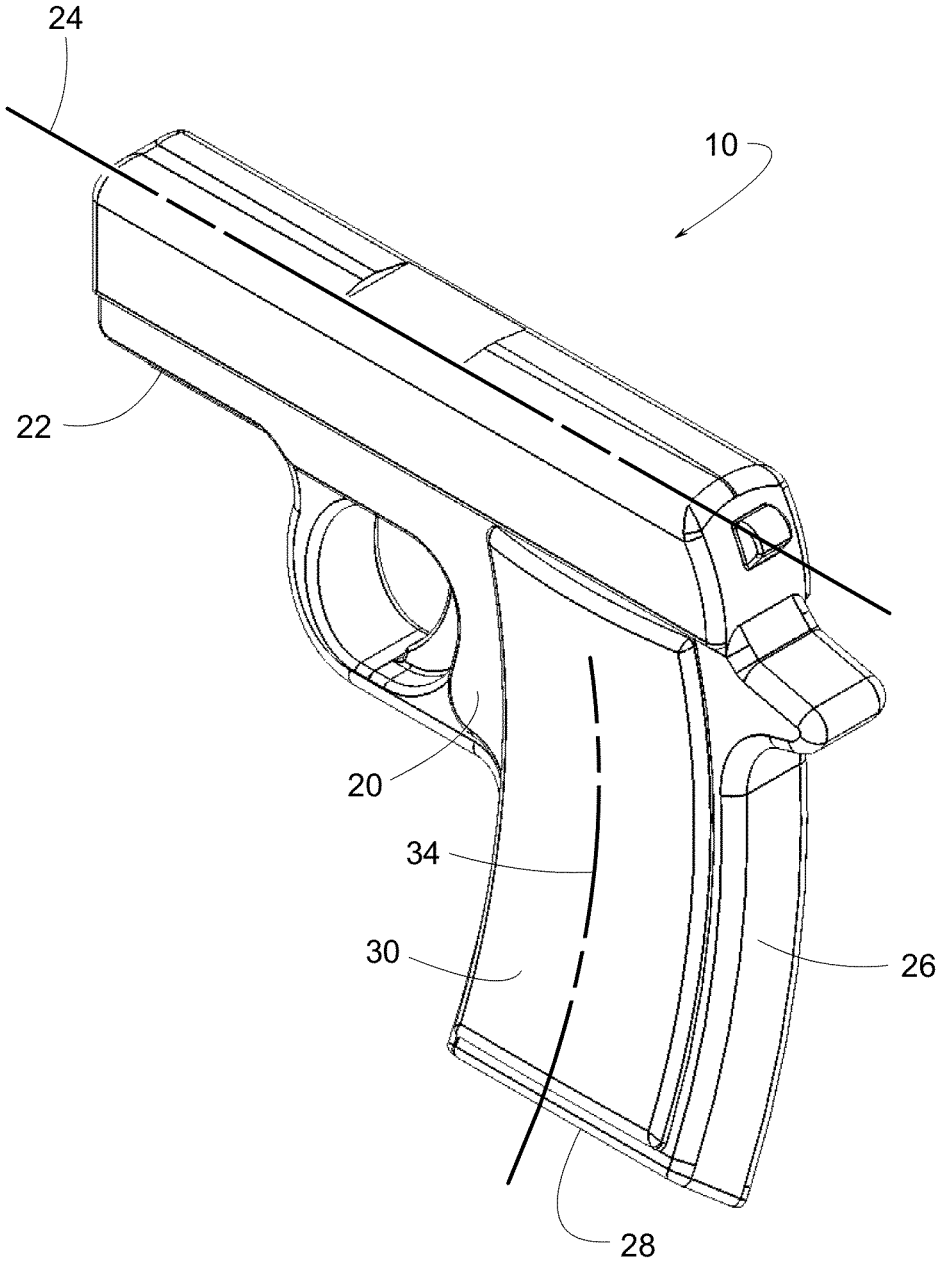
FIG. 1 is a perspective view of an example handgun.
Figure 2:
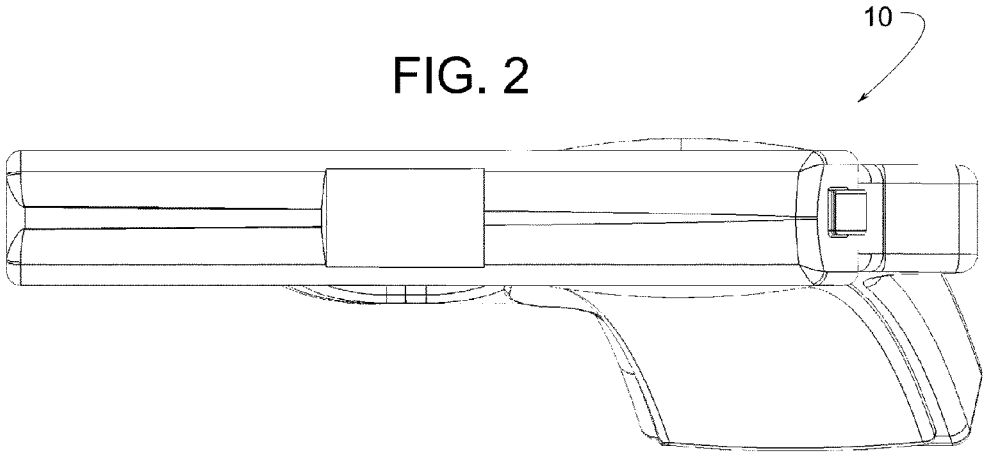
FIG. 2 is a top view of FIG. 1.
Figure 3:
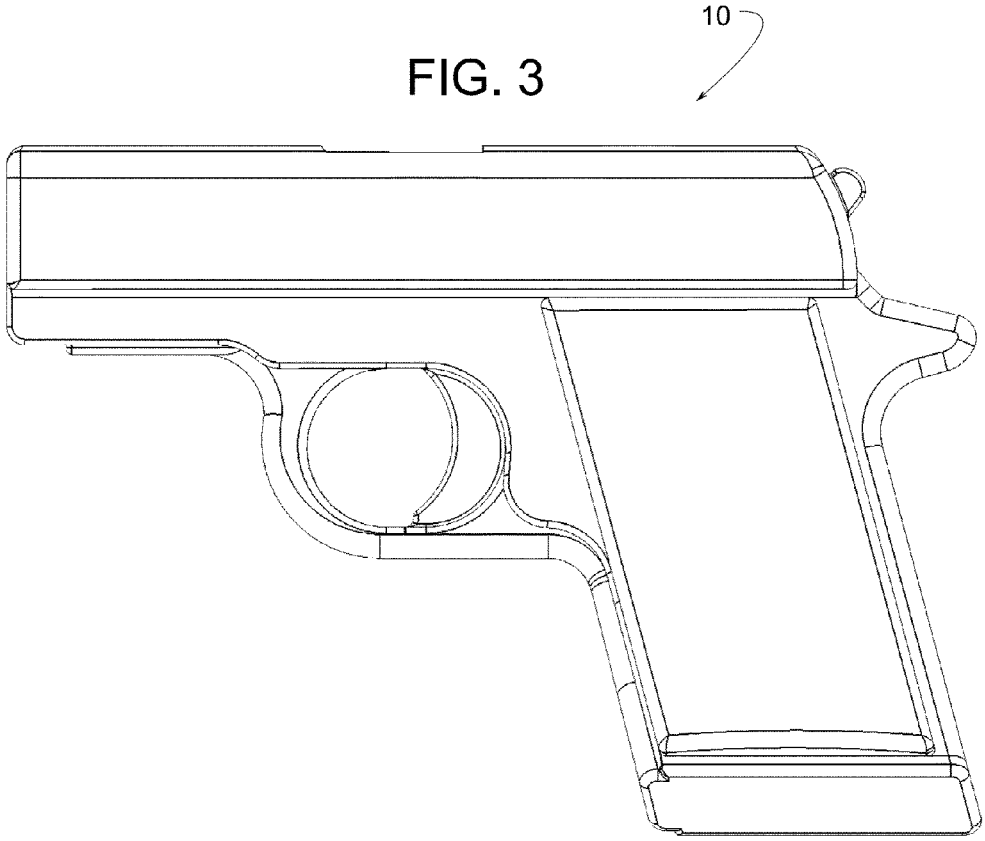
FIG. 3 is a left side view of FIG. 1.
Figure 4:
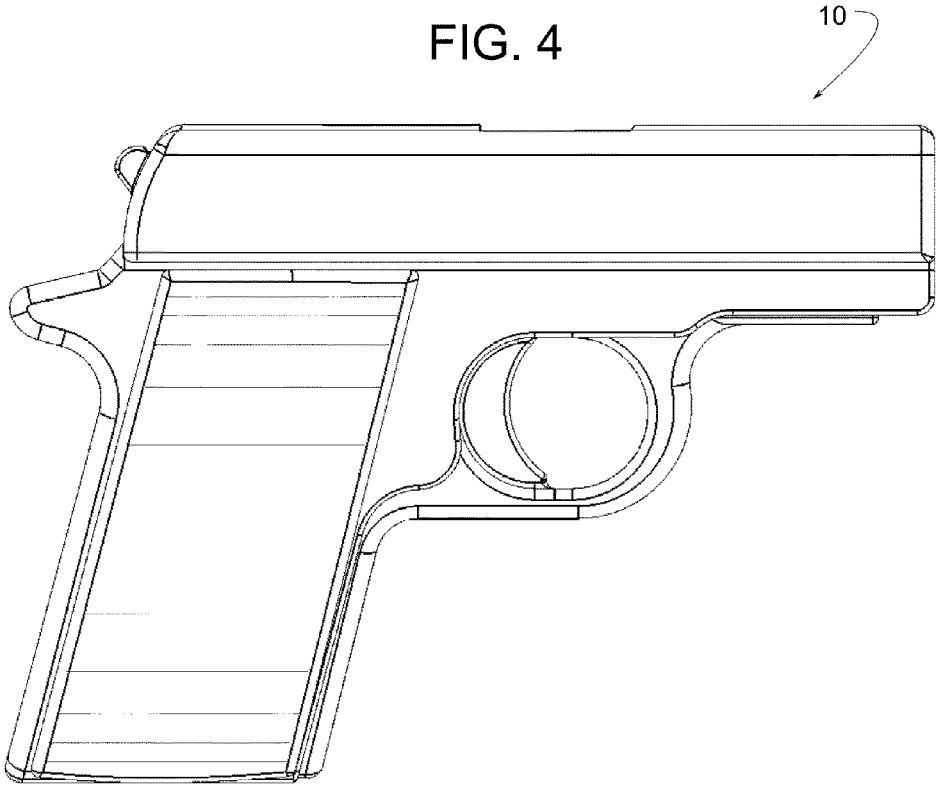
FIG. 4 is a right side view of FIG. 1.
Figure 5:
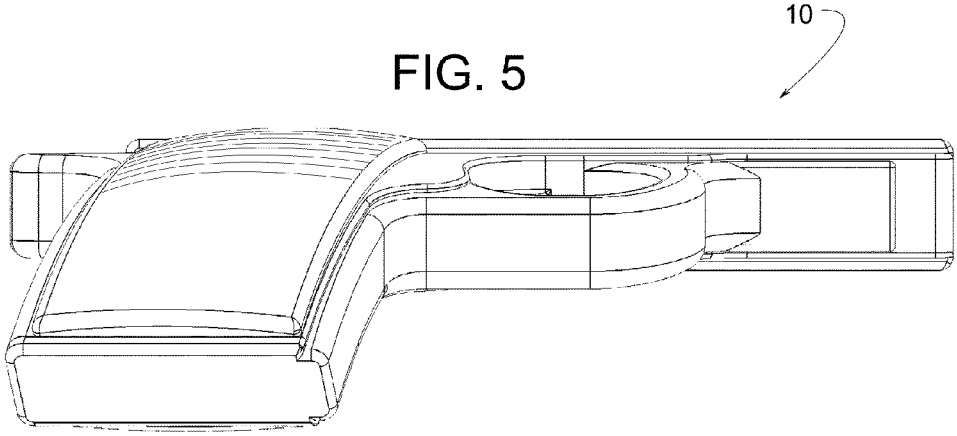
FIG. 5 is a bottom view of FIG. 1.
Figure 6:
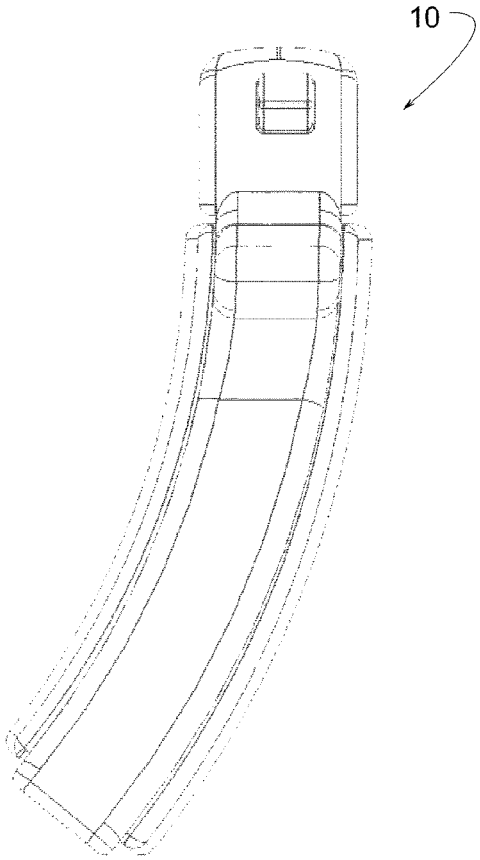
FIG. 6 is a back end view of FIG. 1.
Figure 7:
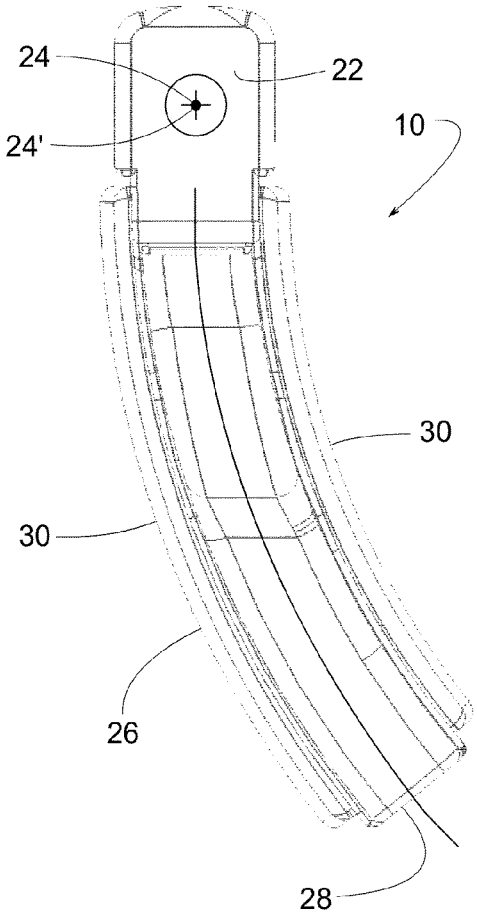
FIG. 7 is a front end view of FIG. 1.
Figure 8:
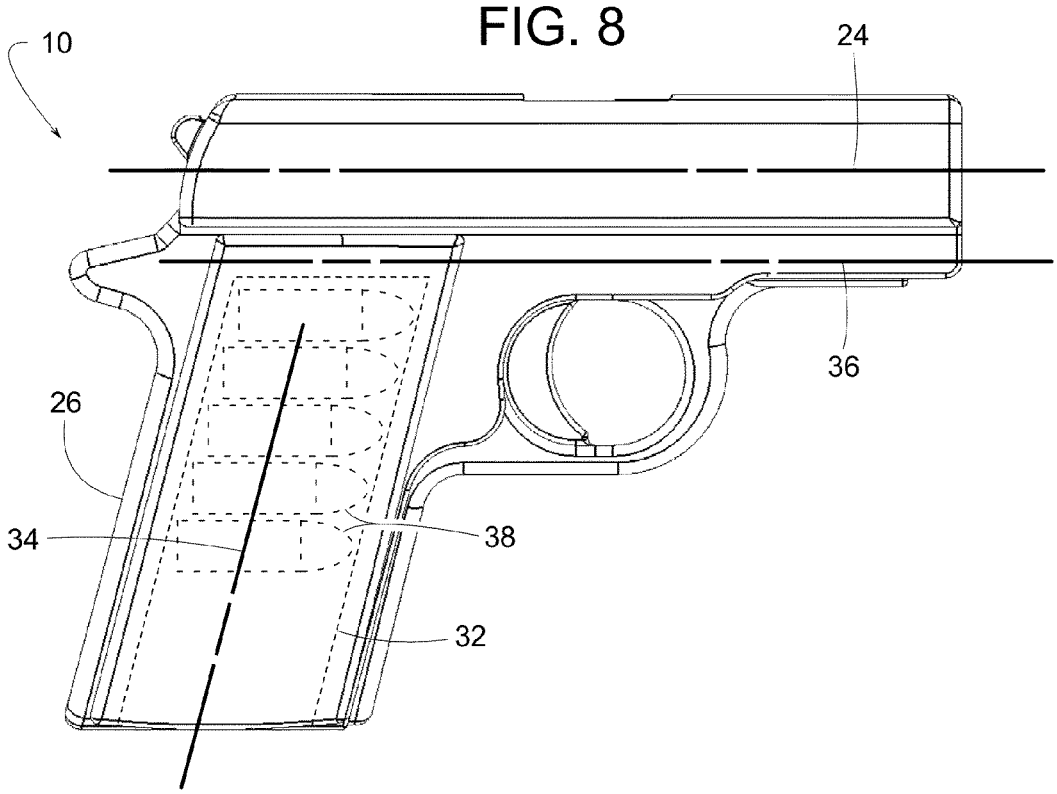
FIG. 8 is a side view similar to FIG. 4 but also showing additional geometric lines.

Referring specifically to FIGS. 8 and 9, to make handgun 10 fit comfortably in the front or rear pocket of a pair of pants, some examples of magazine 32 have a cartridge feed path 34 that curves about an axis of curvature 36, wherein the axis of curvature 36 is substantially parallel to or at least not perpendicular to the barrel's longitudinal centerline 24. Cartridge feed path 34 is the direction in which magazine 32 sequentially conveys a plurality of cartridges 38 to the barrel's longitudinal centerline 24. In some examples, longitudinal centerline 24 and axis of curvature 36 are coplanar in that they both lie in a common plane 40.

In some examples, the curved shape of handgun 10 is described with reference to FIG. 10, which is an end view geometric depiction and silhouette of handgun 10. The end view of FIG. 10 is viewed from an imaginary plane perpendicular to the barrel's longitudinal centerline 24, thus longitudinal centerline 24 appears as centerline point 24' in FIG. 10. In addition to FIG. 10 showing the end view silhouette of handgun 10 (e.g., an end view silhouette of FIG. 7), FIG. 10 also shows various imaginary lines, circles, points, dimensions and other geometric references such as a first circle 42, a first center point 44 of first circle 42, a first diameter 46 of first circle 42, a second circle 48, a second center point 50 of second circle 48, a main circle 52, a main center point 54 of main circle 52, a main radius 56 of main circle 52, a linear distance 58 between first center point 44 and centerline point 24', and an arc length 60 along the circumference of main circle 52 between first center point 44 and centerline point 24'.

First circle 42 is inscribed within handle 26 touching distal end 28 and both side faces of handle 26. Second circle 48 is inscribed within handle 26 such that second circle 48 touches both side faces of handle 26 with second center point 50 being equidistant from centerline point 24' and first center point 44. Second center point 50 being equidistant from centerline point 24' and first center point 44 means the linear distance from second center point 50 to first center point 44 equals the linear distance from second center point 50 to centerline point 24'. Points 24', 50 and 44 define main circle 52 in that all three points 24', 50 and 44 lie on the circumference of main circle 52.

To provide handgun 10 with a shape that fits comfortably within pants pocket 14, in some examples, main radius 56 divided by linear distance 58 is a value of within 1.1 to 1.7. In some examples, main radius 56 divided by linear distance 58 equals 1.4.

To provide handgun 10 with a shape that fits comfortably within pants pocket 14, in some examples, main radius 56 is within 6.4 cm to 20.3 cm. In some examples, main radius 56 equals 11.6 cm.

To provide handgun 10 with a shape that fits comfortably within pants pocket 14, in some examples, centerline point 24' and first center point 44 with reference to main center point 54 are angularly spaced apart by 0.47 to 0.98 radians. In some examples, centerline point 24' and first center point 44 with reference to main center point 54 are angularly spaced apart by 0.68 radians.

To provide handgun 10 with a shape that fits comfortably within pants pocket 14, in some examples, handgun 10 has a radial aspect ratio of 3.9 to 5.8, wherein the radial aspect ratio is defined herein as a quotient of main radius 56 divided by first diameter 46. In some examples, handgun 10 has a radial aspect ratio of 4.9.

To provide handgun 10 with a shape that fits comfortably within pants pocket 14, in some examples, arc length 60 between points 24' and 44 minus linear distance 58 between points 24' and 44 is a delta length of within 0.7 to 3.0 mm. In some examples, the delta length equals 1.5 mm.

Referring to FIGS. 11 and 12, handgun 12 in the form of a revolver comprises a frame 62, a barrel 64 defining a longitudinal centerline 66 (projectile centerline), a cylinder 68 and a handle 70 extending from longitudinal centerline 66 and terminating at a distal end 72. In some examples, handle 70 is an integral extension of frame 62, wherein handle 70 and frame 62 are a single piece.

In some examples, the curved shape of handgun 12 (FIGS. 11 and 12) is described with reference to FIG. 13, which is an end view geometric depiction and silhouette of handgun 12. The end view of FIG. 12 is viewed from an imaginary plane perpendicular to the barrel's longitudinal centerline 66, thus longitudinal centerline 66 appears as centerline point 66' in FIG. 12. In addition to FIG. 13 showing the end view silhouette of handgun 12 (e.g., an end view silhouette of FIG. 12), FIG. 13 also shows various imaginary lines, circles, points, dimensions and other geometric references such as a first circle 74, a first center point 76 of first circle 74, a first diameter 78 of first circle 74, a second circle 80, a second center point 82 of second circle 80, a main circle 84, a main center point 86 of main circle 84, a main radius 88 of main circle 84, a linear distance 90 between first center point 76 and centerline point 66', and an arc length 92 along the circumference of main circle 84 between first center point 76 and centerline point 66'.

First circle 74 is inscribed within handle 70 touching distal end 72 and both side faces of handle 70. Second circle 80 is inscribed within handle 70 such that second circle 80 touches both side faces of handle 70 with second center point 82 being equidistant from centerline point 66' and first center point 76. Second center point 82 being equidistant from centerline point 66' and first center point 76 means the linear distance from second center point 82 to first center point 76 equals the linear distance from second center point 82 to centerline point 66'. Points 66', 82 and 76 define main circle 84 in that all three points 66', 82 and 76 lie on the circumference of main circle 84.

To provide handgun 12 with a shape that fits comfortably within pants pocket 14, in some examples, main radius 88 divided by linear distance 90 is a value of within 1.1 to 1.7. In some examples, main radius 88 divided by linear distance 90 equals 1.4.

To provide handgun 12 with a shape that fits comfortably within pants pocket 14, in some examples, main radius 88 is within 6.4 cm to 20.3 cm. In some examples, main radius 88 equals 11.6 cm.

To provide handgun 12 with a shape that fits comfortably within pants pocket 14, in some examples, centerline point 66' and first center point 76 with reference to main center point 86 are angularly spaced apart by 0.47 to 0.98 radians. In some examples, centerline point 66' and first center point 76 with reference to main center point 86 are angularly spaced apart by 0.68 radians.

To provide handgun 12 with a shape that fits comfortably within pants pocket 14, in some examples, handgun 12 has a radial aspect ratio of 3.9 to 5.8, wherein the radial aspect ratio is defined as a quotient of main radius 88 divided by first diameter 78. In some examples, handgun 12 has a radial aspect ratio of 4.9.

To provide handgun 12 with a shape that fits comfortably within pants pocket 14, in some examples, arc length 92 between points 66' and 76 minus linear distance 90 between points 66' and 76 is a delta length of within 0.7 to 3.0 mm. In some examples, the delta length equals 1.5 mm.

For comparison, prior art handgun 16 of FIG. 16 shows a first inscribed circle 94 with a first center point 96, a second inscribed circle 98 with a second center point 100, and a centerline point 102 representing the barrel's longitudinal centerline. FIG. 16 shows a nearly straight line 104 passing through points 102, 100 and 96. Similarly, prior art handgun 18 of FIG. 17 shows a first inscribed circle 106 with a first center point 108, a second inscribed circle 110 with a second center point 112, and a centerline point 114 representing the barrel's longitudinal centerline. FIG. 17 also shows a nearly straight line 116 passing through points 114, 112 and 108.

Although the invention is described with respect to a preferred embodiment, modifications thereto will be apparent to those of ordinary skill in the art. The scope of the invention, therefore, is to be determined by reference to the following claims:

The invention claimed is:

1. A handgun comprising:

a barrel defining a longitudinal centerline;

a curved handle having a first end proximate said barrel and a distal end opposite said first end, said handle having a curvature substantially traversing an arc segment of a circle that is in a plane substantially perpendicular to said longitudinal centerline of said barrel, said arc segment approximately intersecting said longitudinal centerline of said barrel at said first end and approximately bisecting said distal end; and a curved magazine having a curved housing substantially disposed within the curved handle, the curved magazine defining a cartridge feed path substantially traversing said arc segment.

2. The handgun of claim 1, wherein the longitudinal centerline of the barrel and the axis of curvature are substantially coplanar.

3. The handgun of claim 2, wherein the longitudinal centerline of the barrel is substantially parallel to the axis of curvature.

4. A handgun comprising:

a barrel defining a longitudinal centerline that is perpendicular to an end view of the handgun, the longitudinal centerline appearing as a centerline point as viewed in the end view of the handgun; and a handle extending from the longitudinal centerline and terminating at a distal end as viewed in the end view of the handgun, a first circle inscribed within the handle and touching the distal end as viewed in the end view of the handgun, the first circle having a first center point, a second circle inscribed within the handle as viewed in the end view of the handgun, the second circle having a second center point that is equidistant from the centerline point and the first center point, a main circle defined by the first center point, the second center point and the centerline point all lying on a circumference of the main circle, the main circle having a main radius and a main center point, the first circle having a first diameter, the centerline point and the first center point being spaced apart by a linear distance, the main radius divided by the linear distance being a value of within 1.1 to 1.7; and a curved magazine having a curved housing substantially disposed within said handle, said curved magazine housing having a cartridge feed path, said cartridge feed path curved about an axis of curvature, and the axis of curvature of the cartridge feed path being substantially parallel to the longitudinal centerline of the barrel.

5. The handgun of claim 4, wherein the centerline point and the first center point with reference to the main center point are angularly spaced apart by 0.47 to 0.98 radians.

6. The handgun of claim 4, wherein the handgun has a radial aspect ratio defined as a quotient of the main radius divided by the first diameter, the radial aspect ratio being within 3.9 to 5.8.

7. The handgun of claim 4, wherein the main radius is within 6.4 cm to 20.3 centimeters.

8. The handgun of claim 7, wherein the linear distance divided by the first diameter is a quotient between 2.3 and 6.8.

9. A handgun comprising:

a barrel defining a longitudinal centerline that is perpendicular to an end view of the handgun, the longitudinal centerline appearing as a centerline point as viewed in the end view of the handgun; and a handle protruding in a direction leading away from the longitudinal centerline and terminating at a distal end as viewed in the end view of the handgun, a first circle inscribed within the handle and touching the distal end as viewed in the end view of the handgun, the first circle having a first center point, a second circle inscribed within the handle as viewed in the end view of the handgun, the second circle having a second center point that is equidistant from the centerline point and the first center point, a main circle defined by the first center point, the second center point and the centerline point all lying on a circumference of the main circle, the main circle having a main radius and a main center point, the first circle having a first diameter, the centerline point and the first center point being spaced apart by a linear distance, the main radius being within 6.4 to 20.3 centimeters; and a curved magazine having a curved housing substantially disposed within said handle, said curved magazine housing having a cartridge feed path, said cartridge feed path curved about an axis of curvature, and the axis of curvature of the cartridge feed path being substantially parallel to the longitudinal centerline of the barrel.

10. The handgun of claim 9, wherein the centerline point and the first center point with reference to the main center point are angularly spaced apart by 0.47 to 0.98 radians.

11. The handgun of claim 9, wherein the handgun has a radial aspect ratio defined as a quotient of the main radius divided by the first diameter, the radial aspect ratio being within 3.9 to 5.8.

12. The handgun of claim 9, wherein the linear distance divided by the first diameter is a quotient between 2.3 and 6.8.

13. A handgun comprising:

a barrel defining a longitudinal centerline that is perpendicular to an end view of the handgun, the longitudinal centerline appearing as a centerline point as viewed in the end view of the handgun; and a handle having a distal end spaced farthest from the longitudinal centerline as viewed in the end view of the handgun, a first circle inscribed within the handle and touching the distal end as viewed in the end view of the handgun, the first circle having a first center point, a second circle inscribed within the handle as viewed in the end view of the handgun, the second circle having a second center point that is equidistant from the centerline point and the first center point, a main circle defined by the first center point, the second center point and the centerline point all lying on a circumference of the main circle, the main circle having a main radius and a main center point, the first circle having a first diameter, the centerline point and the first center point with reference to the main center point being angularly spaced apart by 0.47 to 0.98 radians; and a curved magazine having a curved housing substantially disposed within said handle, said curved magazine housing having a cartridge feed path, said cartridge feed path curved about an axis of curvature, and the axis of curvature of the cartridge feed path being substantially parallel to the longitudinal centerline of the barrel.

14. The handgun of claim 13, wherein the handgun has a radial aspect ratio defined as a quotient of the main radius divided by the first diameter, the radial aspect ratio being within 3.9 to 5.8.

15. The handgun of claim 13, wherein the longitudinal centerline and the first center point are spaced apart by a linear distance, and the linear distance divided by the first diameter is a quotient between 2.3 and 6.8.

16. A handgun comprising:

a barrel defining a longitudinal centerline that is perpendicular to an end view of the handgun, the longitudinal centerline appearing as a centerline point as viewed in the end view of the handgun; and a handle protruding in a direction leading away from the longitudinal centerline and terminating at a distal end as viewed in the end view of the handgun, a first circle inscribed within the handle and touching the distal end as viewed in the end view of the handgun, the first circle having a first center point, a second circle inscribed within the handle as viewed in the end view of the handgun, the second circle having a second center point that is equidistant from the centerline point and the first center point, a main circle defined by the first center point, the second center point and the centerline point all lying on a circumference of the main circle, the main circle having a main radius, the first circle having a first diameter, the handgun having a radial aspect ratio defined as a quotient of the main radius divided by the first diameter, the radial aspect ratio being within 3.9 to 5.8; and a curved magazine having a curved housing substantially disposed within said handle, said curved magazine housing having a cartridge feed path, said cartridge feed path curved about an axis of curvature, and the axis of curvature of the cartridge feed path being substantially parallel to the longitudinal centerline of the barrel.

17. The handgun of claim 16, wherein the longitudinal centerline and the first center point are spaced apart by a linear distance, and the linear distance divided by the first diameter is a quotient between 2.3 and 6.8.

18. A handgun comprising:

a barrel defining a longitudinal centerline that is perpendicular to an end view of the handgun, the longitudinal centerline appearing as a centerline point as viewed in the end view of the handgun; and a handle protruding in a direction leading away from the longitudinal centerline and terminating at a distal end as viewed in the end view of the handgun, a first circle inscribed within the handle and touching the distal end as viewed in the end view of the handgun, the first circle having a first center point, a second circle inscribed within the handle as viewed in the end view of the handgun, the second circle having a second center point that is equidistant from the centerline point and the first center point, a main circle defined by the first center point, the second center point and the centerline point all lying on a circumference of the main circle, the main circle having a main radius and a main center point, the first circle having a first diameter, the centerline point and the first center point being spaced apart by a linear distance, the centerline point and the first center point being spaced apart by an arc length along the circumference of the main circle, the arc length minus the linear distance being a delta length of within 0.7 to 3.0 millimeters; and a curved magazine having a curved housing substantially disposed within said handle, said curved magazine housing having a cartridge feed path, said cartridge feed path curved about an axis of curvature, and the axis of curvature of the cartridge feed path being substantially parallel to the longitudinal centerline of the barrel.

19. A handgun comprising:

a barrel defining a longitudinal centerline;

a curved handle defining a midpoint line traversing from a first end proximate said barrel to a distal end opposite said first end, said midpoint line having a curvature substantially traversing an arc segment of a circle that is in a plane substantially perpendicular to said longitudinal centerline of said barrel; and a curved magazine having a curved housing substantially disposed within the curved handle.

* * * * *